US006816026B2

(12) United States Patent
Dybdal

(10) Patent No.: US 6,816,026 B2
(45) Date of Patent: Nov. 9, 2004

(54) ORTHOGONAL POLARIZATION AND FREQUENCY SELECTABLE WAVEGUIDE USING ROTATABLE WAVEGUIDE SECTIONS

(75) Inventor: Robert B. Dybdal, Palos Verdes Estates, CA (US)

(73) Assignee: The Aerospace Corporation, El Segundo, CA (US)

( * ) Notice: Subject to any disclaimer, the term of this patent is extended or adjusted under 35 U.S.C. 154(b) by 275 days.

(21) Appl. No.: 09/220,184

(22) Filed: Dec. 22, 1998

(65) Prior Publication Data

US 2004/0183615 A1 Sep. 23, 2004

(51) Int. Cl.[7] ..... H01P 1/161
(52) U.S. Cl. ..... 333/21 A; 33/106; 33/108
(58) Field of Search ..... 333/106, 108, 333/135, 21 A

(56) References Cited

U.S. PATENT DOCUMENTS 2,423,130 A * 7/1947 Tyrell ..... 333/108
2,588,934 A * 3/1952 Miller ..... 333/108
2,788,494 A * 4/1957 Vogeley, Jr. et al. ..... 333/106
2,912,694 A * 11/1959 Phillips, Jr. ..... 333/106 X
3,009,117 A * 11/1961 Lanctot ..... 333/108
3,015,079 A * 12/1961 Lactot ..... 333/108
3,112,459 A * 11/1963 Blass et al. ..... 333/108
3,243,733 A * 3/1966 Hosman ..... 333/106
4,945,320 A * 7/1990 Hettlage et al. ..... 333/106

FOREIGN PATENT DOCUMENTS

RU 824350 * 4/1981 ..... 333/106

* cited by examiner

*Primary Examiner*—Benny Lee
(74) *Attorney, Agent, or Firm*—Derrick Michael Reid

(57) ABSTRACT

A selectable waveguide transitions between two positions to at least two independent signals by their polarization or frequency. This waveguide consists of dissimilar wave sections coupled to an antenna feed and is mechanically actuated for signal selection switching to route signals to output ports and respective probes that are polarization sensitive. The waveguide sections offer high polarization purity so that signal components remain separated to avoid mutual interference and low insertion loss to maintain system efficiency. Selectable waveguide can be extended for multiple polarization and frequency operation. Frequency selective surfaces and tapers establish pass bands and attenuation levels for frequency selection. The selectable waveguide is suitable for both frequency and polarization selectively in antenna system. Selectable waveguides can be cascaded and mechanically actuated for creating selectable waveguides arrangements enabling a wide variety of frequency and polarization selectively operating through a single apparatus.

10 Claims, 5 Drawing Sheets

ORTHOGONAL POLARIZATION AND FREQUENCY SELECTABLE WAVEGUIDE USING ROTATABLE WAVEGUIDE SECTIONS

STATEMENT OF GOVERNMENT INTEREST

The invention was made with Government support under contract No. F04701-93-C-0094 by the Department of the Air Force. The Government has certain rights in the invention.

FIELD OF THE INVENTION

The invention relates to the field of antenna systems used in satellite communications where orthogonal polarizations are employed to increase system capacity.

BACKGROUND OF THE INVENTION

The demands for satellite communication capacity have resulted in the implementation of several different techniques. One technique is to extend satellite capacity using orthogonal polarization states to send two independent signals to the same coverage region thereby doubling the information that can be delivered to that region. This technique is referred to as polarization reuse. The success of this technique depends in part on the ability to maintain the separation of the two signals to avoid mutual interference that degrades communication performance. The required signal separation in turn imposes requirements on the polarization purity of the signals.

Polarization reuse is very commonly used on commercial satellites operating at the C band (4–6 GHz) and Ku band (11–14 GHz) frequencies. The required separation between signals used in these systems depends on the power differences in the signal levels and the susceptibility of the reception to co-channel interference. A typical requirement for the polarization purity needed for signal separation is to limit the reception of the undesired signal to a level that is 27 dB lower, that is, 1/500 of the power, than the desired signal component. The degree of polarization purity needed to satisfy this requirement is significantly more stringent than the polarization purity required to insure minimal signal loss caused by polarization mismatch.

Different satellite systems, however, are not consistent in the polarization states used. Some systems use orthogonal linear polarization states while other systems use orthogonal circular polarization states. Within a given satellite system, antenna systems for a single polarization state have been developed. However, if antenna systems are developed for use with several different satellite systems, the antenna system requires the capability to select the polarization state depending on the satellite system being used. Clearly, antenna systems capable of operating with different satellite systems afford advantages in flexibility and potential cost effectiveness. However, such antenna designs have to be fully compatible with the requirements for each satellite system. In view of the various polarization signaling methods, antenna systems designed for inter-program compatibility must be capable of processing dual polarization signals with either linear or circular polarization states and must meet system requirements for polarization purity.

The design requirements to achieve the requisite polarization purity must address the antenna, its feed system, and the ports for each polarization. These design requirements must be maintained over the entire bandwidth spanned by the satellite systems. The antenna, for example, must be designed with a high degree of symmetry so that cross polarized components are not generated that would degrade polarization purity. Similarly, the feed system must be designed to produce rotationally symmetric illumination of the antenna system and attention must be paid to the excitation of higher order modes that produce cross polarized components that degrade polarization purity. The terminals of the feed system must be constructed with precision to avoid polarization coupling, and any combining circuitry used to transform polarization states must satisfy stringent matching requirements to avoid the generation of cross polarized components that degrade polarization purity. The satisfaction of the overall system requirements for polarization purity is limited by the aggregate of the imperfections in the antenna, feed system, terminals and transforming circuitry.

One fundamental limitation in the development of designs that permit selection of the polarization state results from the inherent imperfections when hybrid combining circuitry is used to transform polarization states. The conventional approach to this problem is to combine one of the polarization states with hybrid circuitry to obtain the other polarization state. The limitation of this approach lies with the inherent imperfections of the hybrid. Quadrature hybrids needed to convert the linearly polarized state to the circular polarized state can maintain a ninety degree phase shift but the amplitude response is unequal over the bandwidth. This amplitude imbalance results in coupling between the two polarization states resulting in co-channel interference. When linearly polarized components are transformed to circularly polarized components, for example, the circular components are obtained from the addition of equal levels of each linearly polarized component with a ninety degree phase shift between the components. Such combining is typically implemented using a quadrature hybrid. Practical hybrids provide the appropriate ninety degree phase shift but exhibit the problem of an imbalance when combining the amplitudes that then varies over the required bandwidth. This amplitude combining imbalance is a limiting factor in achieving the polarization isolation needed to maintain signal separation. A similar limitation exists with one hundred and eighty degree hybrids used to combine circularly polarized components to obtain linearly polarized components. One problem with-one hundred and eighty degree hybrids is the resulting phase imbalance. A second problem is the insertion loss inherent when using combining circuitry results. Such insertion loss degrades system sensitivity. The insertion loss reduces transmitted power delivered to the antenna and also limits the power handling because the thermal energy resulting from the insertion lose must be dissipated. The insertion loss in receiving antennas not only reduces the received signal strength but also increases the total system temperature, a factor that is extremely important when modern low noise receivers are used.

A means of switching is also required to select between the polarization states. Three distinct switch technologies exist. Diode switch devices can switch very rapidly but are relatively lossy and limited in their power handling capability. Ferrite switching technology has somewhat less loss, slower switching time, and greater power handling capability and very low loss, but with disadvantageous slow switching times. The low loss and power handling capabilities are desired in this polarization reuse applications and rapid switching may not present a problem. Thus, waveguide switch technology is preferred in this polarization reuse application having low loss and high power handling capabilities, but with slow switching times. Conventional waveguide switch has a single dominant waveguide mode. A dominant waveguide mode may be TE01 or TE10 for square waveguides and orthogonally disposed TE11 for circular waveguides. Tapers and frequency selective surfaces have long been used for frequency isolation. The most familiar waveguide switch uses rotating waveguide bends to route the signals between four ports. The conventional waveguide switch has two selectable position settings for aligning two curved waveguide section bends symmetrical about a rotating axis. The curved selectable waveguide section does not use reflecting surfaces, and is limited to rectangular cross section waveguide sections incapable of communicating orthogonally polarized signals. This dual position arrangement is analogous to a double-pole double throw switch. This configuration in commonly referred to as a baseball switch, because the waveguide bends resemble the stitching on a baseball. However, this switch technology is not capable of switching orthogonally polarized signals because the bends inherently result in coupling between the linear and circular polarized signals. These and other disadvantages are solved or reduced using this invention.

SUMMARY OF THE INVENTION

An object of the invention is the capability to receive and/or transmit dual orthogonally polarized signals with selection between linear and circular states.

Another object of the invention is to achieve a high degree of polarization purity over a wide bandwidth to avoid co-channel interference of one signal to another.

Yet another object of the invention is to achieve a low lose design to increase system efficiency in antenna systems.

A further object of the present invention is to provide the means of transmitting and/or receiving two orthogonally polarized antenna signals with a high degree of polarization purity and with low loss and the capability to select either linearly or circularly polarized polarization states.

Yet a further object of the present invention is to provide the capability for a dual polarized, selectable polarization state waveguide capable of operation for multiple frequency bands.

The present invention is directed towards a waveguide switch having a plurality of switch positions for communicating a signal between at least one input port and a respective plurality of output ports through a respective plurality of dissimilar waveguide sections. In the preferred form, the waveguide switch has two output ports respectively connected to the input port through a straight waveguide section and a bent waveguide section. The waveguide switch is preferably used to receive and/or transmit dual polarized signals through an antenna feed input port between a linear output port using the bent waveguide section coupled to a linear polarization state sensitive probe and a circular output port coupled to a circular polarized probe using the straight waveguide section providing the capability to select either linearly or circularly polarized polarization state signal transmitted through the antenna feed port. This present invention provides a high level of polarization purity needed to separate two independent signals by polarization. The present invention is directed to selectable waveguides having selectable waveguide sections to perform the polarization state selection, and the loss incurred by these sections is much less than the losses in hybrid combining circuitry used in the conventional polarization state transformations. The waveguide sections can be sized, cascaded and coupled to frequency sensitive tapers and couplers for both polarization state selection and frequency selection of signals in applications where multiple frequency or multiple polarization state operation is required, for example, in simultaneous C band and Ku band operation.

The preferred selectable waveguide has two positions for respectively selecting one of two waveguide sections within the selectable waveguide. The selectable waveguide is capable of propagating the two independent orthogonal polarized channels. A waveguide is connected to an antenna feed capable of propagating two independent orthogonally polarized communication channels. A selector switch, knob, or other mechanical means on the waveguide is used to select one of the two waveguide sections to thereby select one of the two independent orthogonally polarized communication channels. Output ports of the selectable waveguide are used for separating the respective polarization states of the channels using respective polarization sensitive probes. The waveguide switch is thus used to route the transmitting or receive channel signals into either the circular polarized output port realized by an orthomode transducer capable of high polarization purity over wide bandwidths or to the linear polarized output port realized by an orthogonal linear polarized probe in the waveguide capable of high polarization purity over wide bandwidths.

Preferably, the selector switch is used to transfer either linear or circular polarization signal components to respective ports. Like the conventional waveguide switch, the selection is preferably accomplished by mechanical rotation. Unlike conventional switches, however, the improved selectable waveguide has dissimilar waveguide sections that can respectively operate in two dominant modes. One switch setting consists of a straight waveguide section so that higher order modes and mode coupling does not occur. The second switch setting changes the direction of propagation by ninety degrees using a waveguide miter bend to avoid higher order mode generation. The axis of rotation is offset to permit the rotation of the switch and the port alignment. The improved selectable waveguide switch of the present invention is effectively a single-pole double-throw waveguide switch using three ports.

These selectable waveguide switches can be frequency sized and cascaded for multiple frequency applications. Such cascading can be readily performed when the switch has the straight waveguide section. When the switch is placed in the position of bent section containing a miter bend, the conducting miter is replaced by a frequency selective surface to allow passage of the higher frequency signals to subsequent selector waveguide switches. Frequency sensitive couplers and tapers can be coupled to the switches to various operational configurations for selecting the signal of desired frequency and polarization. In addition to the ability to maintain polarization purity, the waveguide sections of the selector switch have little loss in comparison to hybrid network losses in the conventional approach. These and other advantages will become more apparent from the following detailed description of the preferred embodiment.

DETAILED DESCRIPTION OF THE PREFERRED EMBODIMENT

Figure 1:
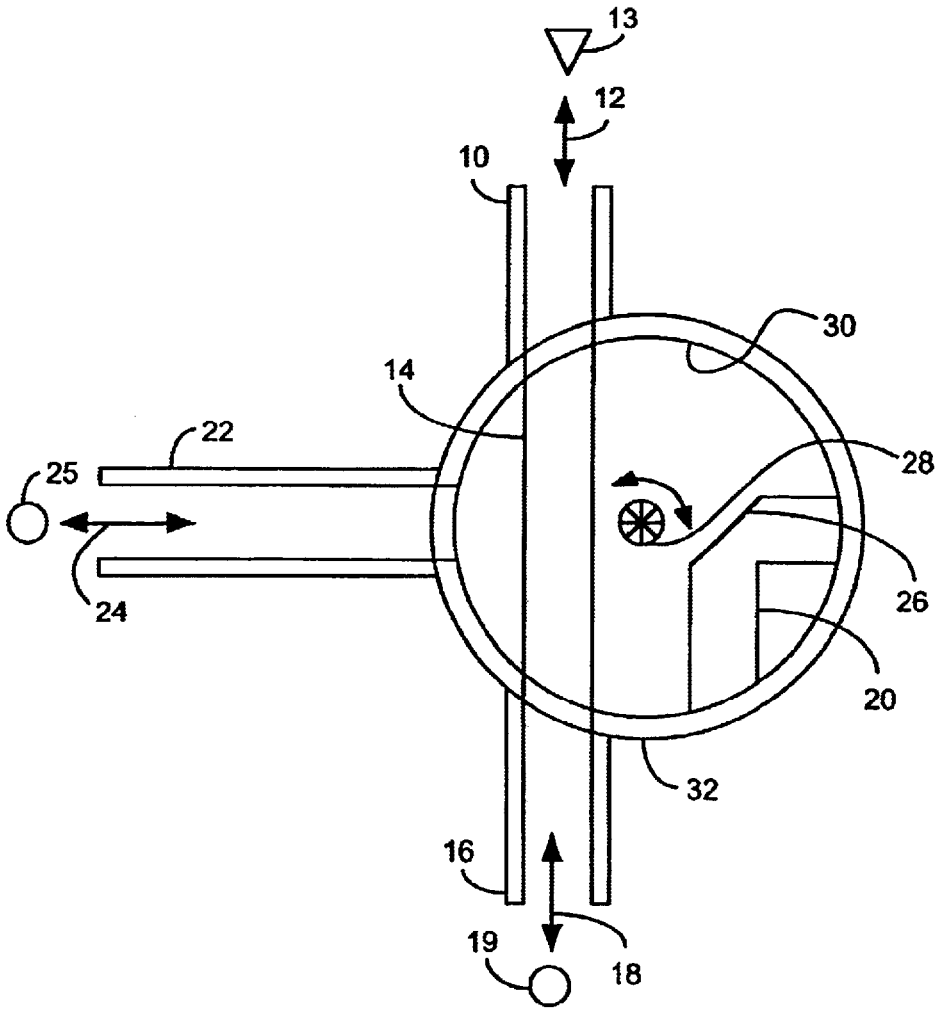
FIG. 1 is a drawing of a selectable waveguide switch shown in the straight position.

An embodiment of the invention is described with reference to the figures using reference designations as shown in the figures. Referring to both FIGS. 1 and 2, a selectable waveguide can be positioned into one of two positions, a straight waveguide position shown in FIG. 1 and a bent waveguide position shown in FIG. 2. An antenna feed port 10 communicates a feed signal 12 to and from an antenna feed 13. In the straight position of FIG. 1, the antenna feed port 10 communicates the feed signal 12 through a straight waveguide section 14 to a circular port 16 communicating a circular port signal 18. The waveguide sections 14 and 20 are physically sized to transmit and receive signals within desired frequencies bands. The circular port signal 16 may be either a linearly polarized signal or a circularly polarized signal or may comprise a plurality of differing polarized signals. The circular port 16 is coupled a circular port probe 19 for communicating the circular port signals 18 to and from the antenna feed port 10. The feed signal 12 is either a linear polarized signal or a circular polarized signal, or may be a composite signal having a plurality of differing polarized signals having respective polarized states. In the bent position of FIG. 2, the selectable waveguide communicates the feed signal 12 through a bent waveguide section 20 to a linear port 22 communicating a linear port signal 24 that may be either a linearly polarized signal or a circular polarized signal and that may comprise a plurality of differing polarized signals. The linear port 22 is coupled to a linear port probe 25 for communicating the linear port signal 24 to and from the antenna feed port 10.

The bent waveguide section 20 has a reflecting surface 26 for reflecting the feed signal 12 and linear port signal 24 communicated through the bent waveguide section 20. The direction of the signal path through the bent waveguide section 20 is reflected by ninety degrees using the reflecting surface 26 in the path of the bent waveguide section 20 to communicate linear polarized signals between the linear port 22 and the antenna feed port 10. The reflecting surface 26 is for reflecting signals 24 and 12 communicated through the bent waveguide section 26. This reflection is achieved by a miter bend to avoid mode conversion and coupling between the polarized component signals of the signals 24 and 12 that would reduce the separation between component signals.

Figure 2:
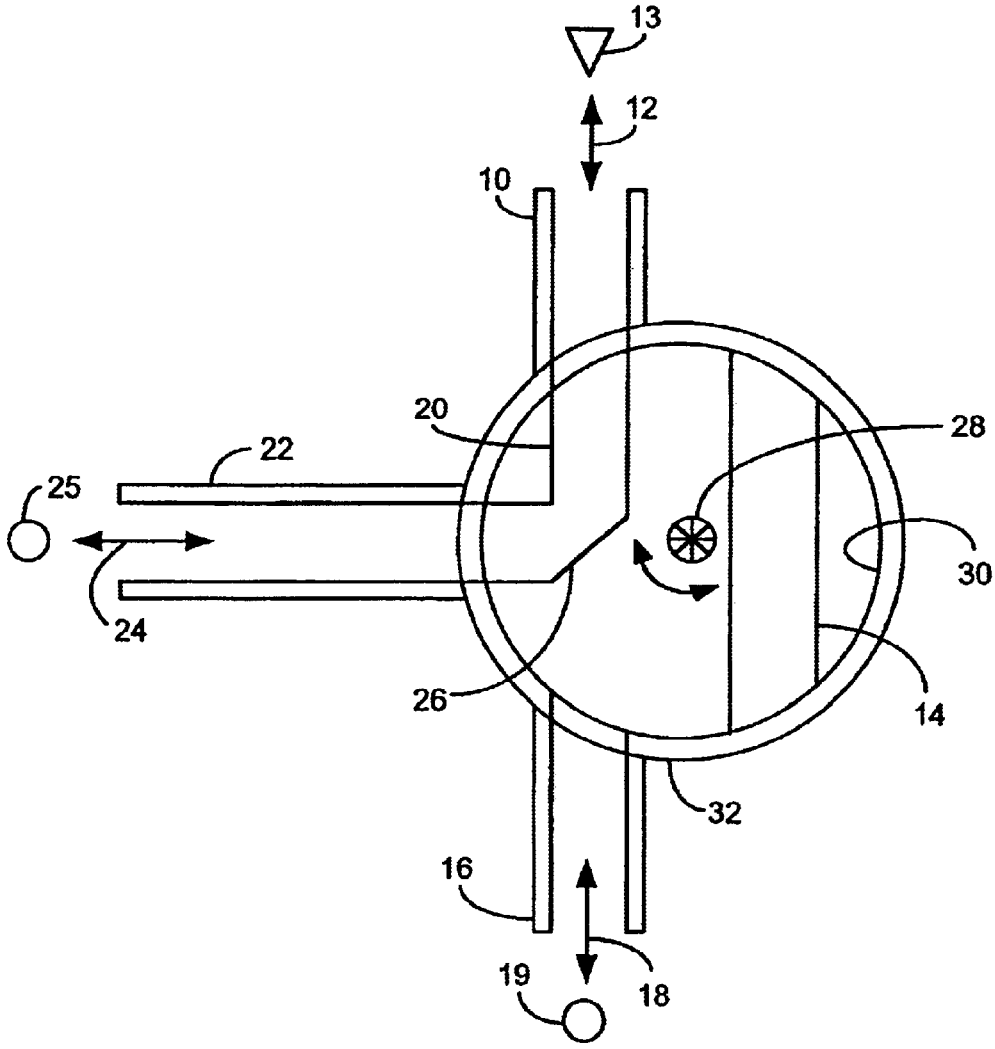
FIG. 2 is a drawing of the selectable waveguide switch shown in the bent position.

From FIGS. 1 and 2, it should be apparent that the bent waveguide section 20 connects the feed port 10 to the port 22 when in a first position, and is therefore dissimilar to in shape to the straight waveguide section 14. Also, the straight waveguide section 14 connects the feed port 10 to the port 16 when in a second position, and is also therefore dissimilar in shape to the bent waveguide section 20. That is, the two waveguide sections 14 and 20 must be dissimilar in shape for connecting the feed port 10 to respective output ports 16 and 22. Additionally, while the preferred form has only two sections 14 and 20, additional sections could be added, so that there is at least a plurality of the dissimilar waveguide with respective sections and output ports.

The port 10 is designated generally as an input port, and, the ports 22 and 16 are designated generally as output ports, but, ports 16 and 22 may transceive respective signals 18 and 24 to and from the port 10 as the feed signal 12. The signal 12 is generally designated as an input signal having a plurality of component signals, such as signals 24 and 18, having differing orthogonal polarization states, such as linear or circular polarization states, left hand circular or right hand circular polarization states, and linear horizontal or linear vertical polarization states. The signal separation and isolation by desired polarization states are realized by polarization sensitive probes 19 and 25 and waveguide switch selection at the respective straight and bent switch positions.

To change positions from a bent waveguide position to and from a straight waveguide position, the selectable waveguide has a rotating selector knob 28 or other mechanical means for rotating a rotating element 30 supporting the bent waveguide section 20 and straight waveguide section 14 on a stationary housing 32. The selectable waveguide preferably uses the rotating element 30 in the stationary housing 32 to change positions for respectively communicating signals 18 or 24. As preferably designated, the selectable waveguide uses the bent waveguide 20 to communicate linearly polarized signals 24 and uses the straight waveguide 14 to preferably communicate circularly polarized signals 18. The bent waveguide section 20 and the straight waveguide section 14 can have either a square or circular cross section and sized for the frequencies of interest. The manually actuated rotating knob 28 is rotated to connect either the bent waveguide 20 or the straight waveguide 14 between the antenna feed port 10 and either of the linear port 22 or the circular port 16, respectively. Hence, the bent waveguide section 20 preferably communicates a linearly polarized signal 24 as feed signal 12 between the linearly polarized port 22 and the antenna feed port 10, and, the straight waveguide section 14 preferably communicates circular polarized signals 18 as feed signal 12 between the circularly polarized port 16 and the antenna feed port 10. Hence, the rotating knob 28 only has two positions, the first position connecting the linear port 22 to the antenna feed port 10 for linearly polarized signal communication as shown in FIG. 2, and the second position connecting the circular port 16 to the antenna feed port 10 for circularly polarized signal communication as shown in FIG. 1.

The polarization sensitive probes 19 and 25 are preferably used to respectively separate by polarization states the two orthogonal polarized signals 18 and 24. The linear port 22 may communicate two independent signals separated by orthogonal polarization states, such as, linear horizontal and linear b vertical polarization states. Likewise, the circular port 16 may communicate two independent signals separated by orthogonal polarization states, such as, left hand and right hand circular polarization signals. Each of the probes 19 or 25 are preferably responsive to a predetermined polarization state and as such are used to isolate and separate two independent orthogonally polarized component signals.

By rotating the rotating element for waveguide section alignment, the probes 19 and 25 are thereby rotated into a position for receiving or transmitting one of the plurality of differing polarized signals, thereby perfecting a polarization state selection. The cross sections of waveguide 14 and 20 remains unaltered from the antenna feed port 10 to either of the linear port 22 and the circular port 16. The cross section areas of the waveguide sections 14 and 20 remain fixed within the selectable waveguide. Because the waveguide cross section remains unchanged, no mechanism exists for polarization modifications from antenna feed port 10 through the waveguide sections 14 and 20 to the respective ports 16 and 22. Consequently, the waveguide does not degrade polarization isolation. The waveguide cross sections 14 and 20 may be square and in this case the signals are propagated on TE01 and TE10 waveguide modes. The waveguide cross section can also be circular and the signals 18 and 24 are propagated on orthogonal TE11 waveguide modes. Hence, the waveguide cross section of the sections 14 and 20 is preferably preserved throughout the rotating member 30.

The waveguide section selection, and hence polarization state selection, by rotating the knob 28, may be by conventional mechanical means to route the feed signals 12 to one of port 22 and 16 to thereby place a respective polarization sensitive probe 25 or 19 in the path of feed signal 12. Like conventional waveguide baseball switches, the rotation can be manually performed or accomplished by using a motor drive that can be remotely controlled. However, the waveguide section selection knob 28 has the improved features of offering polarization state selection using dissimilar waveguide sections 14 and 20 and using respective dissimilar polarization state sensitive probes 19 and 25. The rotating knob 28 is used to both select one waveguide section 14 or 20, and to simultaneously select the one of the two respective probes 19 and 25 to perfect polarization state selection. The first switch selection position selects the straight waveguide section 14 and probe 19 to connect the antenna feed port 10 to the circular port 16, and to select ,the polarization sensitive probe 19 communicating signal 18 of one polarization state as shown in FIG. 1. The second switch selection position is obtained by rotating the knob one hundred and eighty degrees to select the bent waveguide section 20 of the selectable waveguide to connect the antenna feed port 10 to the linear port 22, and to select the probe 25 communicating signal 24 having a differing polarization state as shown in FIG. 2. Hence, the knob 28 is in effect a polarization state selection knob 28 to select one of a plurality of orthogonally polarized signals without coupling energy between the signals that would otherwise degrade the signal separation.

Communication devices, such as probes 19 and 25, connected at the circular port 16 and the linear port 22, are designed to separate the component signals by their polarization states. A means for separating polarized signals 10 is to place probes in a waveguide section located ninety degrees apart in adjacent walls of the waveguides. Similarly, the ports 22 and 16 would separate polarized signals typically by an orthomode probe. These probes for separating signals by polarization are well known and capable of operation over wide bandwidths.

The losses in dual polarized signal communication through the selectable waveguide result from the losses within the waveguide sections 14 and 20 which losses are very small. The losses in the waveguide sections 14 and 20 are less than the insertion losses associated with conventional hybrid networks. Thus, signal reception and transmission for the present invention are more efficient. The waveguide sections 14 and 20 are preferably used to select one of the two orthogonally polarized signals by virtue of the polarization sensitivity of the probes 19 and 25, but can also be used to select signals 18 and 24 of differing frequencies.

Figure 3A:
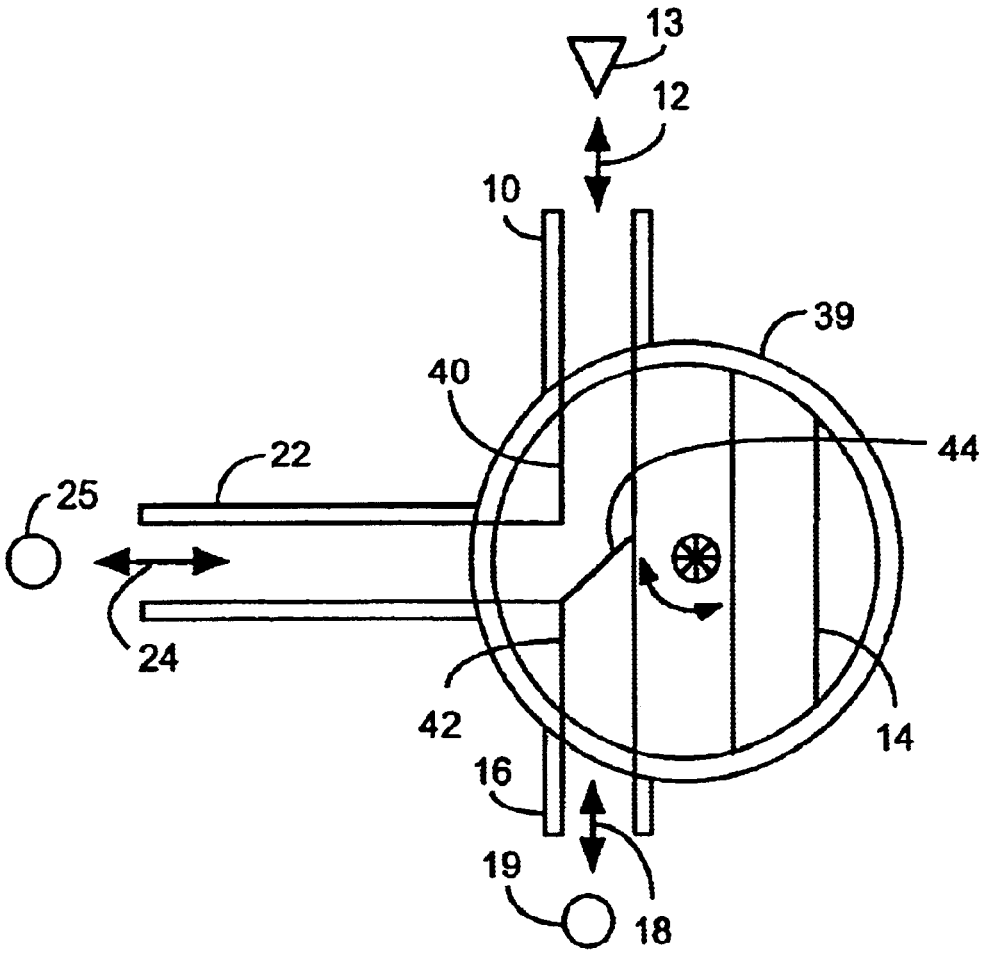
FIG. 3*a* is a drawing of a modified selectable waveguide having a modified bent waveguide section.

Referring to FIG. 3*a*, a modified selectable waveguide 39 may be used for both polarization state and frequency selection of the feed signal 12 communicated to the antenna feed 13 through port 10 with the straight waveguide section 14 not being selected. The input port 10 receives from the antenna 13 the polarized signal 12 and communicates the signal 12 through either of the waveguide sections 14 and 20 depending on which of the sections 14 or 20 is in alignment with the input port 10. The modified selectable waveguide section 40 can be used in applications where multiple frequency operation is required. The waveguide 39 is initially sized to communicate signals within desired frequency bands. The modified selectable waveguide 39 includes a modified bent waveguide section 40 having an extended straight portion 42 and a frequency selective reflective surface 44. The extended portion 42 is aligned to the port 16 when the bent waveguide section 40 is aligned to port 22 when the modified selectable waveguide 39 is switched to the bent position. The frequency selective reflective surface 44 is used to reflect signals 24 of one frequency, such as low frequency signals, to the port 22, and to pass signal of another frequency, such as high frequency signals 18, to the port 16. The probes 19 and 25 can then be used to select signals of differing polarization states, and by virtue of the frequency sensitive reflective surface 44, concurrently select signals of differing frequencies.

Figure 3B:
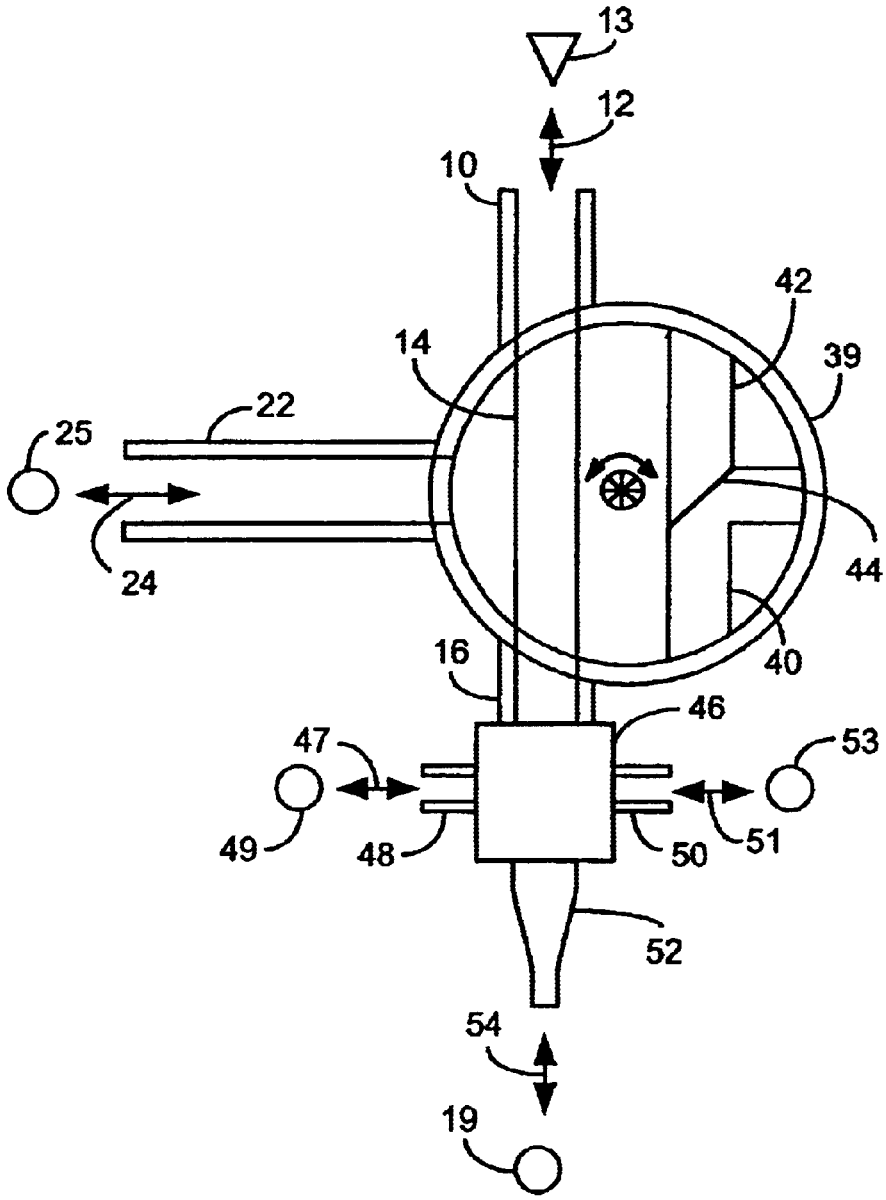
FIG. 3*b* is a drawing of the modified selectable waveguide in the straight position with an attached coupler for multiple frequency operation.

Referring to FIG. 3*b*, the modified selectable waveguide 39 is attached to a coupler 46 having a left hand port 48 communicating left hand port signal 47 to a left hand probe 49, and, having a right hand port 50 communicating right hand port signals 51 to a right hand probe 53. The feed 13 communicates signals 12 through port 10, straight waveguide section 14 and port 16 but not through the extended waveguide portion 42 and the frequency selective reflective surface 44 of bent waveguide section 40 not being selected. As such, the probes 53 and 49 are used to isolate orthogonally polarized signals, such as right hand circular and left hand circular polarized signals. It should be apparent that the coupler 46 functions as a splitter providing two outputs, and that the coupler 46 and probes 49 and 53 could, as well, be attached to port 22 for respectively communicating horizontal linear and vertical linear orthogonally polarized signals 24. The coupler 46 has a taper port 52 for attenuating low frequency component signals and passing high frequency component signals 54 to the probe 19. The input port 10 receives from the antenna 13 the polarized signal 12 and communicates the signal 12 through either of the waveguide sections 14 and 40 depending on which of the sections 14 or 40 is in alignment with the input port 10. The waveguide section-40 has an extended straight portion 42 and a frequency selective reflective surface 44 that is a forty five degree reflective surface used to reflect signals 24 of one frequency, such as low frequency signals, to the port 22 and to pass signals 18 of another frequency, such as high frequency signals, to port 16. The probes 19 and 25 can then be used to select signals of differing polarization states and by virtue of the frequency sensitive reflective surface 44, concurrently select signals of differing frequencies. Hence, the modified selectable waveguide 39 can be modified to include means that provide frequency selection while the probes 25 and 19 can be used to select desired polarization states to isolate signals of interest. It should now be equally apparent, that the selectable waveguide of FIGS. 1 and 2, and or the modified selectable waveguide 39 of FIGS. 3*a* and 3*b*, can be used in combination with various probes, couplers and tapers to isolate signal of desired polarization states and frequencies. Further still, the selectable waveguide of FIGS. 1 and 2, and or the modified selectable waveguide 39 of FIGS. 3*a* and 3*b*, can be cascaded and used in combination with various probes, couplers and tapers to isolate many different signals of respective desired polarization states and frequencies.

Figure 4:
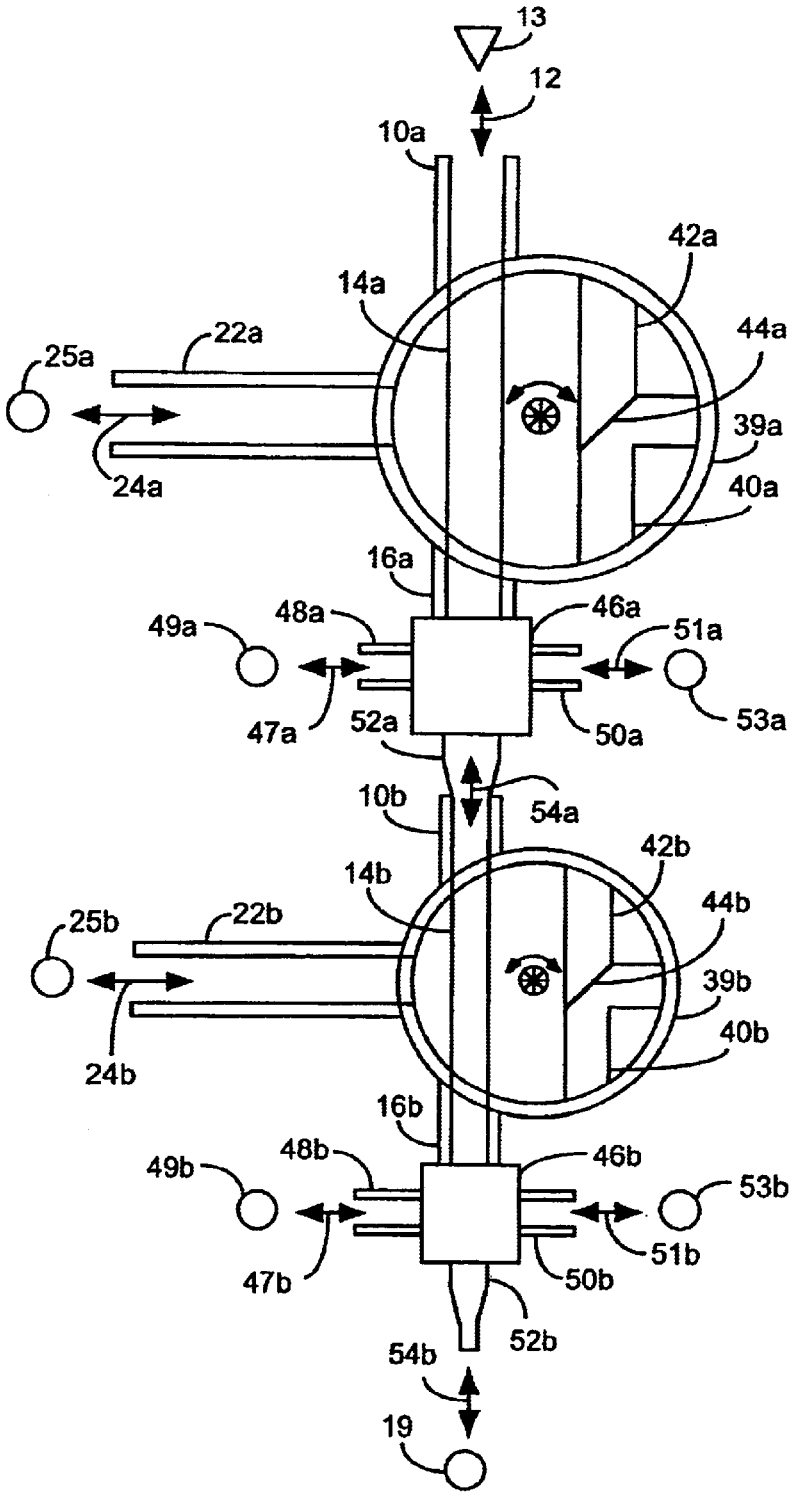
FIG. 4 is a drawing illustrating a cascade arrangement of selectable waveguides for multiple frequency operation.

Referring to FIG. 4, two modified selectable waveguides, a front end waveguide 39*a* and a back end waveguide 39*b*, are cascaded for multiple frequency and multiple polarization state communication applications. Frequency selection and polarization state selection are enabled by the cascaded arrangement in combination with various probes, couplers and tapers. The two waveguides 39*a* and 39*b* are both shown in the straight position, but either or both may be rotated to the bent position, thereby providing a four position cascaded arrangement providing a straight-straight position, a straight-bent position, a bent-straight position and a bent-bent position.

In the straight position, the waveguide dimension is chosen to permit propagation of all system frequencies. The straight position is preferably used for communicating circularly polarized signals at the lower frequencies. All of the signals propagate unmodified through the straight waveguide sections 14*a* and 14*b*. At the output circular port 16*a* of the modified selectable waveguide 39*a*, the coupler 46*a* is used to separate the lowest frequency signals into ports 48*a* and 50*a*. The port 48*a* can be used for left hand polarized signals, and the port 50*a* can be used for selecting right hand polarized signals in the lowest frequency band. The coupler 46*a* is transparent to the higher frequencies. The design of such couplers is well known and commonly used. The waveguide taper 52*a* follows the coupler 46*a* so that the waveguide size is reduced permitting propagation of signals of all frequencies except the lowest frequency signals. The second modified selectable waveguide 39*b* has smaller dimensions and follows the taper port 52*a*. The selectable waveguide 39*a* is transparent to frequency bands above the lowest frequencies. The coupling of the lower frequency band to ports 22*a* and 22*b* is enabled in the bent positions. The miter bends have frequency selection surfaces 44*a* and 44*b* in place of a conducting surface 26 used by the single frequency selectable waveguide switch design. These frequency selective miter surfaces 44*a* and 44*b* reflect the lowest frequency signals 24*a* and 24*b* into the linearly polarized ports 22*a* and 22*b* for connection to respective probes 25*a* and 25*b*. The frequency selective miter surfaces 44*a* and 44*b* are transparent to higher frequencies so that the higher frequency signals 54*a* can be communicated through the cascaded arrangement at the higher frequencies.

Each of the modified selectable waveguides 39*a* and 39*b*, respectively includes ports 16*a* and 16*b*, 22*a* and 22*b*, 48*a* and 48*b*, and 50*a* and 50*b*, tapers 52*a* and 52*b*, straight waveguide sections 14*a* and 14*b*, and bent waveguide sections 40*a* and 40*b*. Waveguide 39*a* has the feed port 10*a* receiving the feed signal 12 and provides the output signal 54*a* that is fed into the feed port 10*b* of waveguide 39*b* to provide the output signal 54*b* to probe 19. Probes 25*a* and 25*b* respectively communicating signals 24*a* and 24*b*, probes 49*a* and 49*b* respectively communicating signals 47*a* and 47*b*, probes 53*a* and 53*b* respectively communicating signals 51*a* and 51*b*, and probe 19 communicating signal 54*b*, all of which can be used for selecting signals of differing frequencies and polarization states. The input port 10*a* receives from the antenna 13 the polarized signal 12 and communicates the signal 12 through either of the waveguide sections 14*a* and 40*a* depending on which of the sections 14*a* or 40*a* of waveguide 39*a* is in alignment with the input port 10*a*. The bent section 40*a* includes a forty five degree reflective surface 44*a* that is used to reflect signals 24*a* of one frequency, such as low frequency signals, to the port 22*a* and to pass signals 54*a* of another frequency, such as high frequency signals, through the port 16*a*, through coupler 46*a* and through to port 52*a* as communication signals 54*a*. The input port 10*b* of waveguide 39*b* receives signals 54*a* from the waveguide 39*a* and communicates the signal 54*a* through either of the waveguide sections 14*b* and 40*b* depending on which of the sections 14*b* or 40*b* of waveguide 39*b* is in alignment with the input port 10*b*. The bent section 40*b* includes a forty five degree reflective surface 44*b* that is used to reflect signals 24*b* of one frequency, such as low frequency signals, to the port 22*b* and to pass signals 54*b* of another frequency, such as high frequency signals, through port 16*b*, through coupler 46*b* and through port 52*b* to the probe 19.

The cascaded arrangement places the low frequency band modified selectable waveguide 39*a* closest to the antenna feed port 10*a* and the antenna feed 13, whereas the high frequency band modified selectable waveguide 39*b* may be used to communicate signals in a high frequency band. In the polarized selectable waveguide 39*a* closest to the antenna feed 13, a modification can be made to the miter bend. In single frequency designs, the miter bend 44*a* consists of a conducting surface 26. In the multiple frequency design, the conducting miter surface 26 is replaced by a frequency selective surface 44*a* capable of reflecting the lowest frequency components and passing the higher frequency components. The coupler 46*a* passes only low frequency signals to ports 48*a* and 50*b*. The coupler 46*b* passes only high frequency signals to the ports 48*b* and 50*b*. Another frequency selective surface 44*b* can be used to prevent mode conversion and signal loss for the higher frequency components. The frequency selective surfaces 44*a* and 44*b* and taper ports 52*a* and 52*b* can be used for low, high, higher frequency band isolation.

In the straight-straight position, the arrangement passes low frequency signals 47*a* and 51*a*, through section 42*a*, passes high frequency signals 54*a*, 47*b* and 51*b*, and passes higher frequency signals 54*b*. In the bent-straight position, the arrangement passes low frequency signals 24*a*, passes high frequency signals 54*a*, 47*b* and 50*b*, and passes higher frequency signals 54*b*. In the straight-bent position, the arrangement passes low frequency signals 47*a* and 51*a*, passes through section 42*a* high frequency signals 54*a*, 24*b*, 47*b* and 51*b*, and passes higher frequency signals 54*b*. In the bent-bent position, the arrangement passes low frequency signals 24*a*, passes high frequency signals 54*a* and 25*b*, and passes through section 42*b* higher frequency signals 47*b*, 51*b*, and 54*b*. Preferably, the port 22*a* communicates low frequency linearly polarized signals 24*a* to probe 25*a*, port 48*a* communicates low frequency left hand circularly polarized signals 47*a* to probe 49*a*, port 50*a* communicates low frequency right hand circularly polarized signals 51*a*to probe 53*a*, port 52*a* communicates high frequency signals to port 10*b*, port 22*b* communicates high frequency linearly polarized signals 24*b* to probe 25*b*, port 48*b* communicates high frequency left hand circularly polarized signals 47*b* to probe 49*b*, port 50*b* communicates high frequency right hand circularly polarized signals 51*b* to probe 53*b*, and port 52*b* communicates higher frequency signals 54*b* to probe 19.

As may now be apparent, several selectable waveguides in combination with various frequency sensitive couplers and tapers can be coupled together and cascaded to provide a plurality of polarization states and frequency selections, all by means of simple rotation of the selectable waveguides. Hence, the selectable waveguide can be used for multiple frequency and multiple polarization selection and operation using both the straight and bent positions and using frequency selective tapers, coupler, and surfaces. These switches are cascaded so that the polarization selection can be made at desired frequencies. This cascade arrangement permits independent polarization selection at each of the used frequencies.

The selectable waveguide switch can be readily applied a frequency selection application. However, other applications exist for the selectable waveguide. Waveguide switches are commonly used to connect other alternatives or redundant electronics into systems. For antennas designed to operate with several different satellites, the selectable switch can be used advantageously with different transmitters. As an example, a system may be required to provide both low and high data rate communications with different satellite systems. The transfer of high data rate information generally requires higher transmitted power than low data rate communications, and the frequency assignments within the band may differ somewhat between the satellite systems. The selectable waveguide switch can be used to connect two different transmitters having different power capabilities to the same antenna feed. Another common requirement is to be able to switch transmitters between the antenna and a dummy load. The dummy load permits operating the transmitters for diagnostic testing without radiating through the antenna causing needless interference. The selectable waveguide switch can be used advantageously in this application permitting use of a single dummy load for both orthogonal polarization states. Such a design can be more compact than one using two dummy loads for each polarization state. Those skilled in the art can make enhancements, improvements, and modifications to enhance the invention and extend the application of the selectable waveguide switch. However, those enhancements, improvements and modifications may nonetheless fall within the spirit and scope of the following claims.

What is claimed is:

1. A selectable waveguide having a first position and a second position for respectively communicating first or second signals from an antenna feed to respective-first and second probes, the selectable waveguide comprising, an antenna feed port coupled to the antenna feed for communicating the respective signals between the antenna feed and the first and second probes, a first waveguide section having a first shape and a first cross-section for coupling to the antenna feed port for communicating the first signal, the first shape is straight, a first port for coupling the first probe to the first waveguide section for communicating the first signal between the first probe and, the first waveguide section, a second waveguide section having a second shape and a second cross-section for coupling to the antenna feed port for communicating the second signal, the second shape is bent at ninety degrees with a forty-five degree reflective surface, a second port for coupling the second probe to the second waveguide section for communicating the second signal between the second probe and the second waveguide section, the first and second cross sections are selected from the group consisting of square and circular, the first and second shapes and the first and second cross sections enable concurrent isolated communications of the first and second signals through either one of the first and second waveguide sections when the first and second signals are orthogonally polarized with respect to each other, and an element for supporting the first and second waveguide sections, the element having a first position for communicating the first signal between the antenna feed port through the first waveguide section to the first port, the element having a second position for communicating the second signal between the antenna feed port through the second waveguide section to the second port, wherein:, the second signal comprises a high frequency signal and a low frequency signal;

the reflective surface is a frequency selective reflective surface for reflecting the low frequency signal to the second port and for passing the high frequency signal to the first port; and the second waveguide section comprises a waveguide extension extending from the frequency selective reflective surface and the first port for communicating the high frequency signal to the first probe through the first port when the selectable waveguide is in the second position.

2. A selectable waveguide having a first position and a second position for respectively communicating first or second signals from an antenna feed to respective first and second probes, the selectable waveguide comprising, an antenna feed port coupled to the antenna feed for communicating the respective signals between the antenna feed and the first and second probes, a first waveguide section having a first shape and a first cross-section for coupling to the antenna feed port for communicating the first signal, the first-shape is straight, a first port for coupling the first probe to the first waveguide section for communicating the first signal between the first probe and the first waveguide section, a second waveguide section having a second shape and a second cross-section for coupling to the antenna feed port for communicating the second signal, the second shape in bent at ninety degrees with a forty-five degree reflective surface, a second port for coupling the second probe to the second waveguide section for communicating the second signal between the second probe and the second waveguide section, the first and second cross sections are selected from the group consisting of square and circular, the first and second shapes and the first and second cross sections enable concurrent isolated communications of the first and second signals through either one of the first and second waveguide sections when the first and second signals are orthogonally polarized with respect to each other, and an element for supporting the first and second waveguide sections, the element having a first position for communicating the first signal between the antenna feed port through the first waveguide section to the first port, the element having a second position for communicating the second signal between the antenna feed port through the second waveguide section to the second port.

3. The selectable waveguide of claim 2 wherein, the element is a rotating element, the first signal is a first polarized signal, the second signal is a second polarized signal, and the selectable waveguide is for selecting the communication of either the first or second polarized signals, wherein the first and second polarized signals being orthogonal with respect to each other.

4. The selectable waveguide of claim 2 wherein, the element is a rotating element, the first signal is a circularly polarized signal, the second signal is a linearly polarized signal, and the selectable waveguide is for selectively communicating either the circularly polarized signal or the linearly polarized signal.

5. A selectable waveguide arrangement for respectively communicating first or second or third signals from an antenna feed to respective first and second and third probes, the selectable waveguide arrangement comprising a front end selectable waveguide and a back end selectable waveguide, wherein, the front end selectable waveguide comprises:

an antenna feed port coupled to the antenna feed for communicating the first and second and third signals between the antenna feed and the first and second and third probes, respectively;

a first front end waveguide section having a first front end shape for coupling to the antenna feed port for communicating the second and third signals;

a first front end port for coupling to the back end selectable waveguide for communicating the second and third signals between the antenna feed port and the back end selectable waveguide;

a second front end waveguide section having a second front end shape for coupling to the antenna feed port for communicating the first signal;

a second front end port for coupling the first probe to the second front end waveguide section for communicating the first signal between the antenna feed port and the first probe through the second front end waveguide section; and a front end element for supporting the first front end waveguide section and the second front end waveguide section, the front end element has a first front end position for communicating the second and third signals between the antenna feed port through the first front end waveguide section through the first front end port to the back end selectable waveguide, the front end element has a second front end position for communicating the first signal between the antenna feed port through the second front end waveguide section through the second front end port to the first probe, and wherein, the back end selectable waveguide comprises:

a back end input port coupled to the first front end port for communicating the second and third signals between the first front end port respectively to the second and third probes;

a first back end waveguide section having a first back end shape for coupling to the back end input port for communicating the second and third signals;

a first back end port for coupling to the first back end waveguide section for communicating the third signal between the back end input port and the third probe through the first back end waveguide section;

a second back end waveguide section having a second back end shape for coupling to the back end input port for communicating the second signal;

a second back end port for coupling the second back end waveguide section to the second probe for communicating the second signal between the back end input port and the second probe through the second back end waveguide section; and a back end element for supporting the first back end waveguide section and the second back end waveguide section, the back end element has a first back end position for communicating the third signal between the back end input port through the first back end waveguide section through the first back end port to the third probe, the back end element has a second back end position for communicating the second signal between the back end input port through the second back end waveguide section through the second back end port to the second probe, one of the first and second front end shapes is straight and the other is bent at ninety degrees, one of the third and fourth back end shapes is straight and the other is bent at ninety degrees, the first and second and third and fourth waveguide sections have cross sections selected from the group of square and circular.

6. The selectable waveguide arrangement and claim 5 wherein, the first and second front end waveguide sections have a larger cross section than the first and second back end waveguide sections, respectively.

7. The selectable waveguide arrangement of claim 5, wherein the second and third signals are respective polarized signals and are orthogonally polarized with respect to respecting each other.

8. The selectable waveguide arrangement of claim 5, wherein the first front end port is a tapered port for attenuating low frequency components of the second and third signals.

9. The selectable waveguide arrangement of claim 5, wherein the third signal comprises a fourth signal and a fifth signal, the selectable waveguide arrangement is coupled to a fourth probe and a fifth probe, the selectable waveguide arrangement further comprises, a coupler coupled to the first front end port and comprising a fourth port and fifth port respectively coupled to the fourth and fifth probes, the fourth and fifth signals are orthogonally polarized with respect to each other and the fourth and fifth probes are polarization sensitive to respectively communicate the fourth and fifth signals between the antenna feed port and the fourth and fifth probes through the first front end waveguide section and fourth and fifth ports.

10. The selectable waveguide arrangement of claim 5 wherein, the first front end waveguide section shape is straight and uniform in cross section and extends from the antenna feed port to the first front end port, the first back end waveguide section shape is straight and uniform in cross section and extends from the back end input port to the first back end port, the second front end waveguide section shape is bent at ninety degrees having a forty-five degree reflective surface and uniform in cross section and extends from the antenna feed port to the second front end port, and the second back end waveguide section shape is bent at ninety degrees having a forty-five degree reflective surface and uniform in cross section and extends from the back end input port to the second back end port.

* * * * *